US008858350B2

(12) United States Patent
Christoffel

(10) Patent No.: US 8,858,350 B2
(45) Date of Patent: Oct. 14, 2014

(54) INFLATABLE ROCKET ASSEMBLY

(71) Applicant: John Stanley Christoffel, Houston, TX (US)

(72) Inventor: John Stanley Christoffel, Houston, TX (US)

( * ) Notice: Subject to any disclaimer, the term of this patent is extended or adjusted under 35 U.S.C. 154(b) by 35 days.

(21) Appl. No.: 13/893,829

(22) Filed: May 14, 2013

(65) Prior Publication Data

US 2013/0310188 A1 Nov. 21, 2013

Related U.S. Application Data

(60) Provisional application No. 61/647,079, filed on May 15, 2012.

(51) Int. Cl.
*A63H 27/00* (2006.01)

(52) U.S. Cl.
CPC ..... *A63H 27/005* (2013.01)
USPC ..... 472/130; 446/220; 446/231

(58) Field of Classification Search
USPC ..... 472/130; 446/231
See application file for complete search history.

(56) References Cited

U.S. PATENT DOCUMENTS

| | | | | |
|---|---|---|---|---|
| 3,210,885 | A * | 10/1965 | Shih et al. | 446/225 |
| 3,229,418 | A * | 1/1966 | Dragich | 446/225 |
| 3,831,315 | A * | 8/1974 | Gilbert | 446/187 |
| 2003/0064658 | A1 * | 4/2003 | Zheng | 446/220 |
| 2005/0009440 | A1 * | 1/2005 | Foster et al. | 446/231 |
| 2005/0191930 | A1 * | 9/2005 | Foster et al. | 446/57 |
| 2008/0045117 | A1 * | 2/2008 | Marin Hernandez | 446/220 |

* cited by examiner

*Primary Examiner* — Michael Dennis

(57) ABSTRACT

An inflatable rocket assembly is an apparatus that improves upon existing rocket shaped balloons. The apparatus is provided in a particular arrangement that enables said inflatable rocket assembly to traverse a fluid, in a particular manner, upon being thrown by human capable means. The inflatable rocket assembly is able to provide amusement and function as a teaching tool to a user through a plurality of interactions. The apparatus utilizes the combination of an inflatable body coupled with a plurality of front fins and a plurality of tail fins in order to achieve a particular flight characteristic while traversing through a fluid. The particular component arrangement allows the inflatable rocket assembly to be thrown through the air, achieving distances of 30' feet or more while requiring very little effort from the user. Furthermore, the inflatable rocket assembly is provided in manner that permits it to be easily inflated and deflated.

12 Claims, 6 Drawing Sheets

INFLATABLE ROCKET ASSEMBLY

The current application claims a priority to the U.S. Provisional Patent application Ser. No. 61/647,079 filed on May 15, 2012.

FIELD OF THE INVENTION

The present invention relates generally to an inflatable amusement device, more specifically to an inflatable rocket assembled by human capable means that provides amusement through a plurality of user interactions.

BACKGROUND OF THE INVENTION

It is well known that balloons are simple fun toys that can be enjoyed by a plurality of individuals. Generally, balloons are sealed volumetric containers with an interior chamber filled pressurized fluid. the fluid within the interior chamber is provided with a pressure greater than ambient atmospheric pressure. The pressure difference between the interior chamber and ambient atmospheric pressure provides the balloon with a light weight semi rigid construction. Additionally it provides the balloon with buoyant properties. Although balloons are known to come in a plurality of shapes and sizes, most balloons are not shaped to effectively traverse through the air.

Prior art exists in the form of 'balloon rockets' which are projectile shaped balloons. These balloon rockets mainly function as a teaching tool but can be additionally used for entertainment purposes. These balloon rockets take time and effort to inflate, and cannot be launched by simply throwing them. In order to provide the balloon rockets with flight, the balloon rocket have to be launched by a water pump or other secondary propulsion device. Upon being launched, these balloon rockets are propelled through the air for a moderate distance.

It is therefore an object of the present invention to provide an apparatus that improves upon existing rocket shaped balloons. The apparatus is provided in a particular arrangement that enables an inflatable rocket assembly to traverse a fluid, in a particular manner, upon being thrown by human capable means. The inflatable rocket assembly is able to provide amusement and function as a teaching tool to a user through a plurality of interactions. The apparatus utilizes the combination of an inflatable body coupled with a plurality of front fins and a plurality of tail fins in order to achieve particular flight characteristic while traversing through a fluid. The particular component arrangement allows the inflatable rocket assembly to be thrown through the air, achieving distances of 30' feet or more requiring very little effort from the user. Furthermore, the inflatable rocket assembly is provided with in manner that permits it to be easily inflated and deflated.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
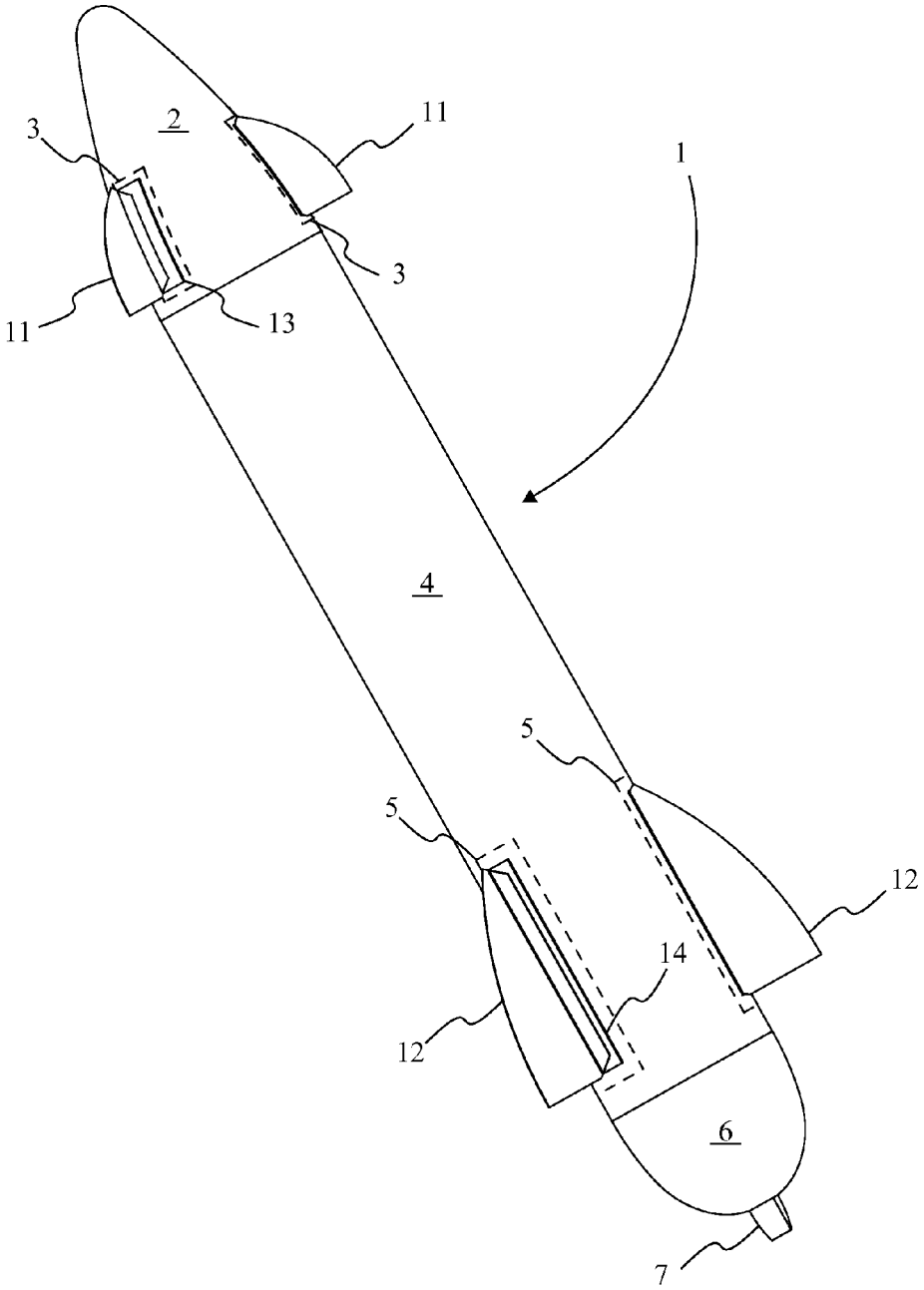
FIG. 1 is a perspective view displaying the component arrangement of the inflatable body, the plurality of front fins, and the plurality of tail fins as per the current embodiment of the present invention.

Referencing FIG. 1, the present invention is an inflatable rocket assembly that provides amusement to a user through a plurality of user interactions. The inflatable rocket assembly is provided in a particular arrangement that enables the inflatable rocket assembly to traverse a fluid, in a particular manner, upon being thrown by human capable means. In the current embodiment of the present invention, the inflatable rocket assembly comprises an inflatable body 1, a fluid delivery conduit 10, front fin adhesive couplers 13, tail fin adhesive couplers 14, a plurality of front fins 11, and a plurality of tail fins 12. The inflatable body 1 is the fuselage of the inflatable rocket assembly that provides an attachment point for the plurality of front fin, the plurality of tail fins 12, the front fin adhesive couplers 13, and the tail fin adhesive couplers 14. The fluid delivery conduit 10 is provided as an attachable component that facilitates the inflation of the inflatable rocket assembly through human capable means. The plurality of front fins 11 function as an array of stabilizing elements that provide the inflatable rocket assembly with directionality while traversing a fluid. The plurality of tail fins 12 function as an array of stabilizing elements that cooperatively function with the plurality of front fins 11 in order to improve directionality of the inflatable rocket assembly while traversing through the fluid. The front fin adhesive couplers 13 function as the coupling element that enables attachment of the plurality of front fins 11 to the inflatable body 1. The tail fin adhesive couplers 14 function as the coupling element that enables the attachment of the plurality of tail fins 12 to the inflatable body 1.

Figure 2:
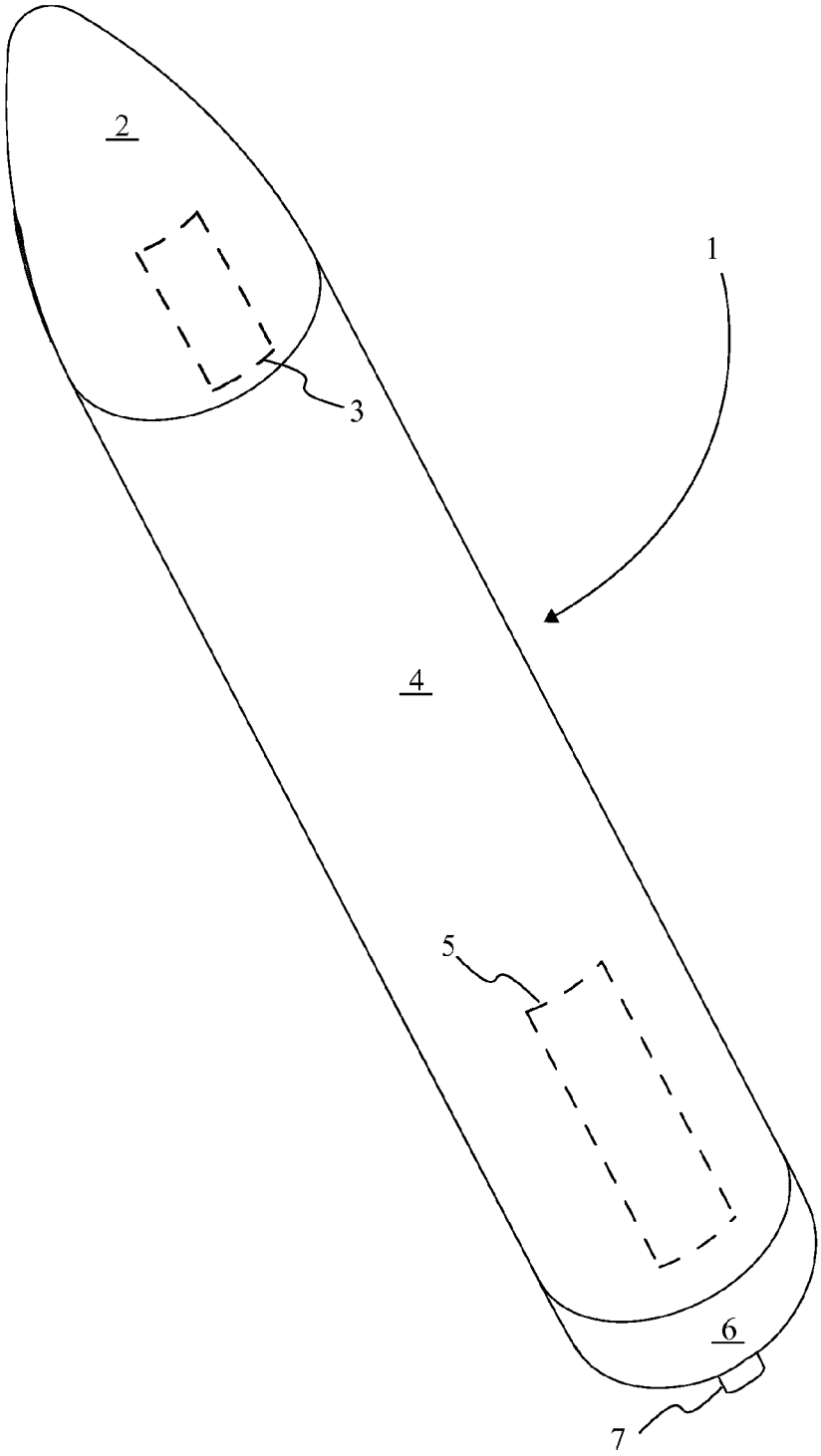
FIG. 2 is a perspective view displaying the component arrangement of the nose cone section, the cylindrical mid section, the tail section, the plurality of front fin mounts, and the plurality tail fin mounts, as per the current embodiment of the present invention.

Referencing FIG. 2, the inflatable body 1 is found concentrically positioned to the plurality of front fins 11, the plurality of tail fins 12, the front fin adhesive couplers 13, and the tail fin adhesive couplers 14, wherein the concentric positioning is based on a radial distribution of the plurality of front fins 11, the plurality of tail fins 12, the front fin adhesive couplers 13, and the tail fin adhesive couplers 14 relative to the inflatable body 1. The inflatable body 1 is found centrally aligned with the fluid delivery conduit 10. The inflatable body 1 is provided with a detachable engagement with the inflatable body 1. The central alignment provided and the detachable engagement provided for the inflatable body 1 and the fluid delivery conduit 10 enables inflation of the inflatable rocket assembly. The front fin adhesive couplers 13 are found positioned between the plurality of front fins 11 and the inflatable body 1, wherein the positioning of the front fin adhesive couplers 13 enables the secure engagement between the plurality of front fins 11 and the inflatable body 1. The tail fin adhesive couplers 14 are found positioned between the plurality of tail fins 12 and the inflatable body 1, wherein the positioning of the tail fin adhesive couplers 14 enables the secure engagement between the plurality of tail fins 12 and the inflatable body 1.

Figure 3:
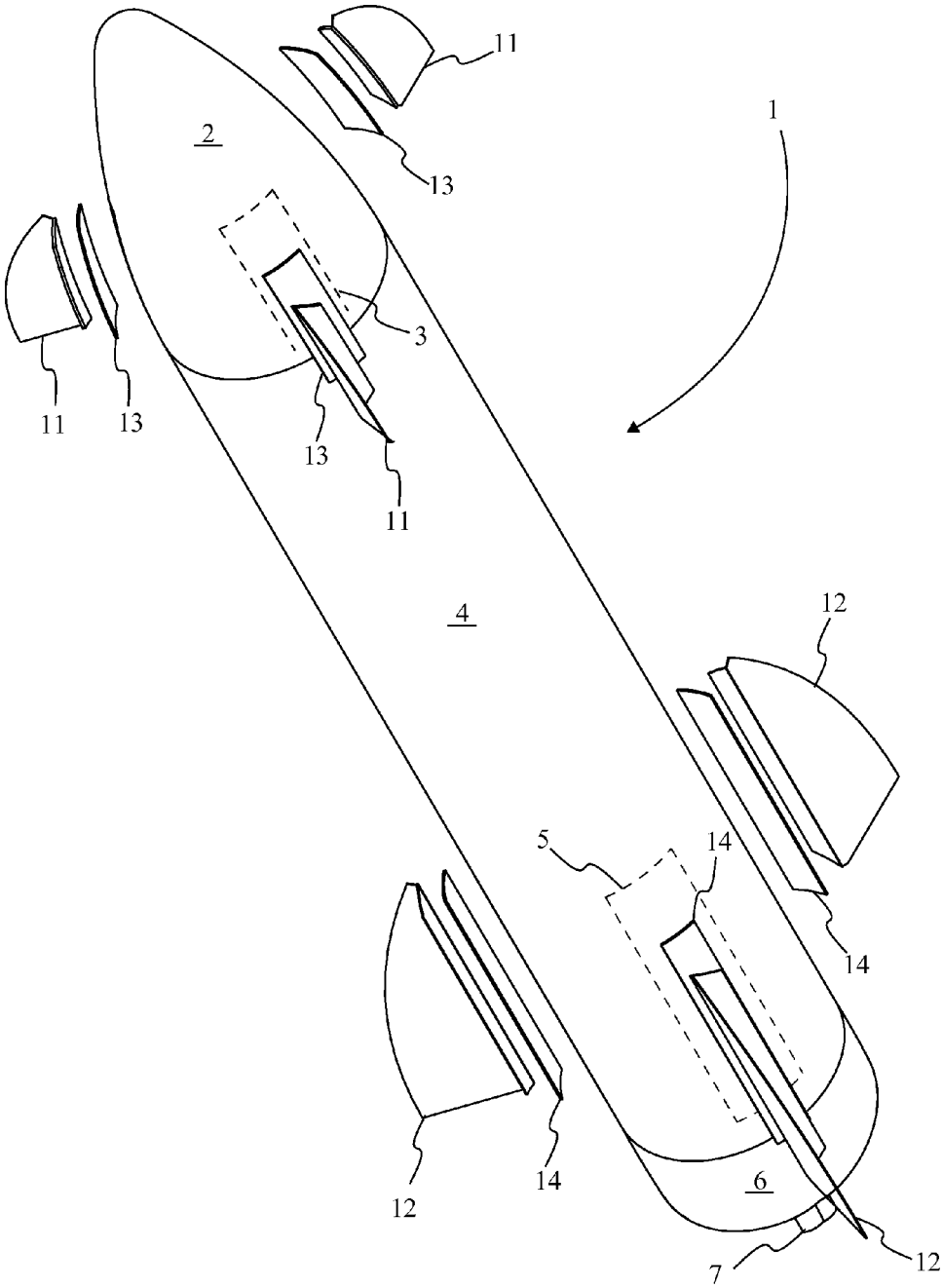
FIG. 3 is an expanded perspective view displaying the component arrangement of the inflatable body, the front fin adhesive couplers, the tail fin adhesive couplers, the plurality of front fins, and a plurality of tail fins as per the current embodiment of the present invention.
Figure 6:
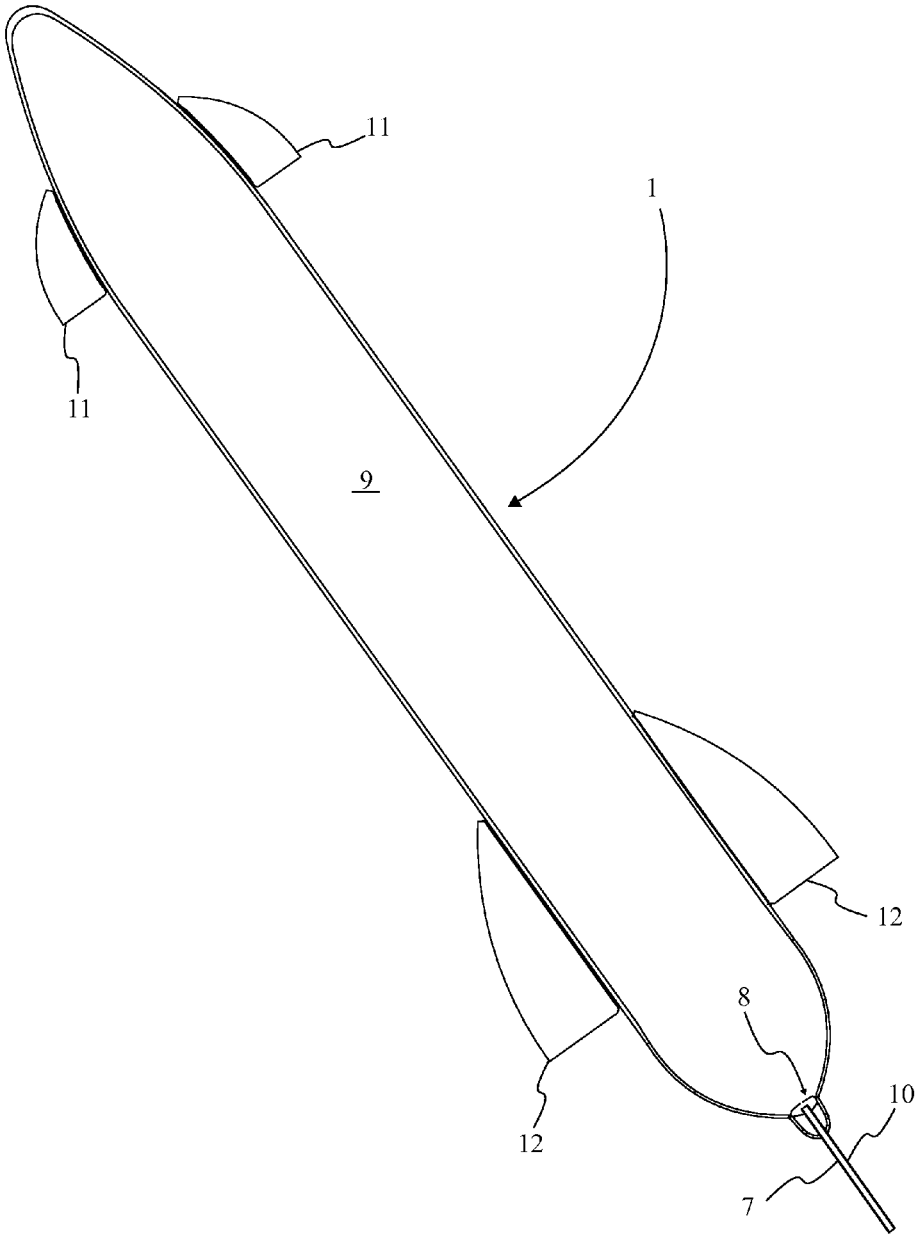
FIG. 6 is a cross-sectional view displaying the relational positioning of the fluid delivery conduit, the conduit mount, and the fluid chamber as per the current embodiment of the present invention.

Referencing FIG. 2, FIG. 3, and FIG. 6, the inflatable body 1, in the current embodiment of the present invention, is the fuselage of the inflatable rocket assembly that provides an attachment point for the plurality of front fin, the plurality of tail fins 12, the front fin adhesive couplers 13, and the tail fin adhesive couplers 14. The inflatable body 1 utilizes a light weight construction in order to facilitate assembly of the inflatable rocket assembly as well as traversal through the fluid. In the preferred embodiment of the present invention the material construction of the inflatable body 1 is biaxially-oriented polyethylene terephthalate (BoPET). BoPET is best known by its trade name of Mylar. In the current embodiment of the present invention, the inflatable body 1 is provided with a mirrored exterior surface. The mirrored exterior surface is functions as a means of facilitating visual identification of the inflatable rocket assembly through the fluid and upon recovery attempts. In the current embodiment of the present invention the inflatable body 1 comprises a nose cone section 2, a cylindrical mid section 4, a tail section 6, and a fluid chamber 9. The nose cone section 2 is provided as the most forwardly positioned section of the inflatable rocket assembly that offers minimum aerodynamic resistance. The cylindrical mid section 4 is provided as the adjacently positioned section to the nose cone section 2 that functions as the fuselage of the inflatable rocket assembly that is positioned between the nose cone section 2 and the tail section 6. The tail section 6 is provided as the rearward most section of the inflatable rocket assembly that is detachably coupled to the fluid delivery conduit 10. The fluid chamber 9 is the directionally biased interior portion of the inflatable rocket assembly that receives fluid from the fluid delivery conduit 10. The fluid chamber 9 is enclosed within the inflatable body 1. The nose cone section 2, the cylindrical mid section 4, and the tail section 6 are found centrally aligned along the length of the inflatable body 1.

Referencing FIG. 2 and FIG. 3, the nose cone section 2 of the inflatable body 1 is provided as the most forwardly positioned section of the inflatable rocket assembly that permits offers the minimum aerodynamic resistance to the inflatable rocket assembly during traversal through the fluid. In the current embodiment of the present invention the nose cone section 2 comprises a plurality of front fin mounts. The plurality of front fin mounts 3 are visual identifiers that coincide with the attachment location of the front fin adhesive couplers 13. The plurality of front fin mounts 3 are circumferentially positioned on the nose cone section 2, wherein the circumferential positioning of the plurality of front fin mounts 3 translates into a particular distribution for the plurality of front fins 11 that directionally influences the path of the inflatable rocket assembly through the fluid.

Referencing FIG. 2 and FIG. 3, the cylindrical mid section 4, in the current embodiment of the present invention, is the centrally positioned section of the inflatable rocket assembly that is found between the nose cone section 2 and the tail section 6. The cylindrical midsection functions as the fuselage of the inflatable rocket assembly. In the current embodiment of the present invention, the cylindrical mid section 4 comprises a plurality of tail fin mounts 5. The plurality of tail fin mounts 5 are visual identifiers that coincide with the attachment location of the tail fin adhesive couplers 14. The plurality of tail fin mounts 5 are circumferentially positioned on the cylindrical mid section 4. The plurality of tail fin mounts 5 are found positioned proximal to the tail section 6. The circumferential positioning and the proximal positioning of the plurality of tail fin mounts 5 translates into a particular distribution for the plurality of tail fins 12 that cooperatively function with the plurality of front fins 11 to influence the path of the inflatable rocket assembly through the fluid.

Figure 4:
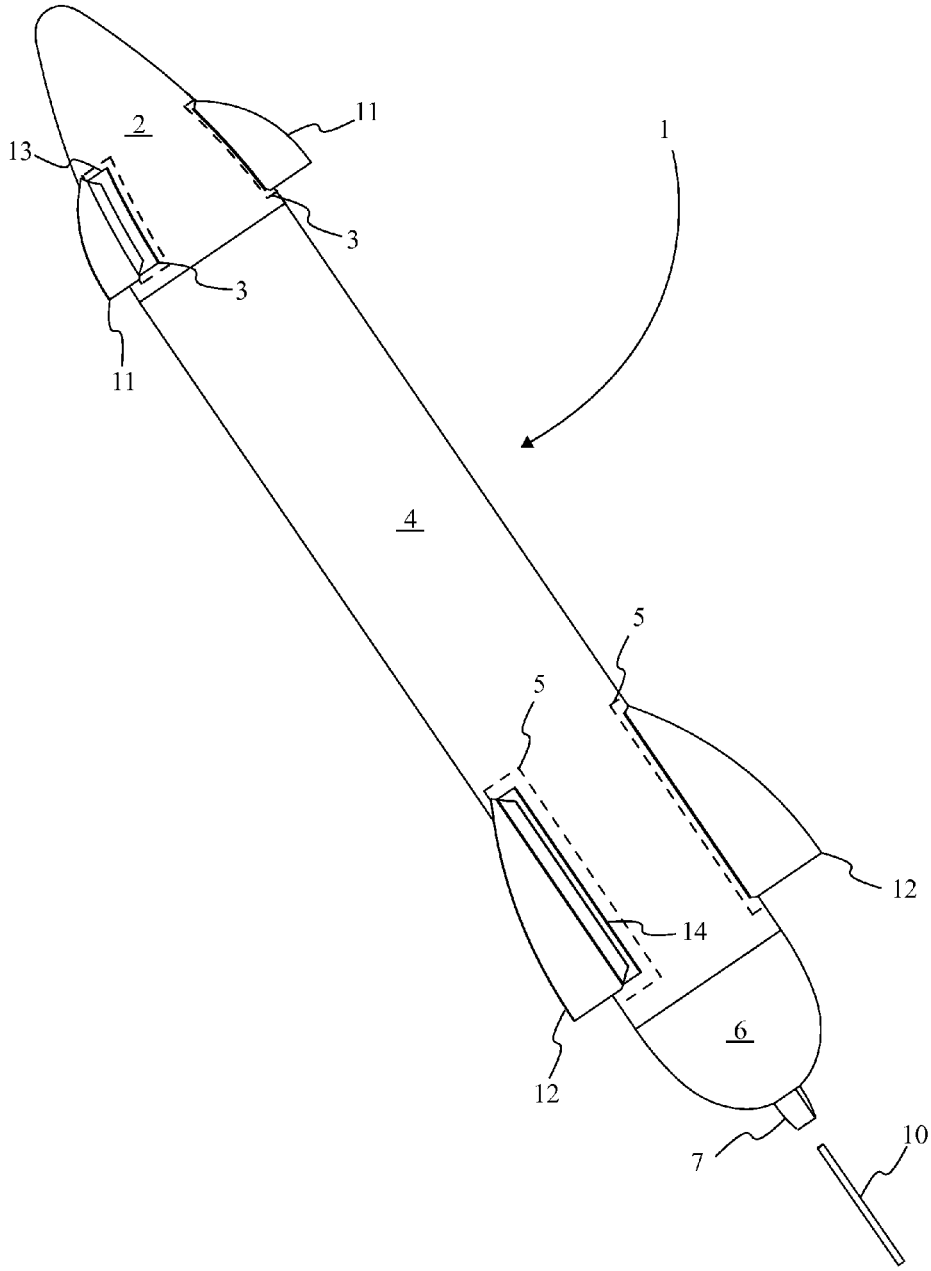
FIG. 4 is a perspective view displaying the alignment of the inflatable body and the fluid delivery conduit as per the current embodiment of the present invention.
Figure 5:
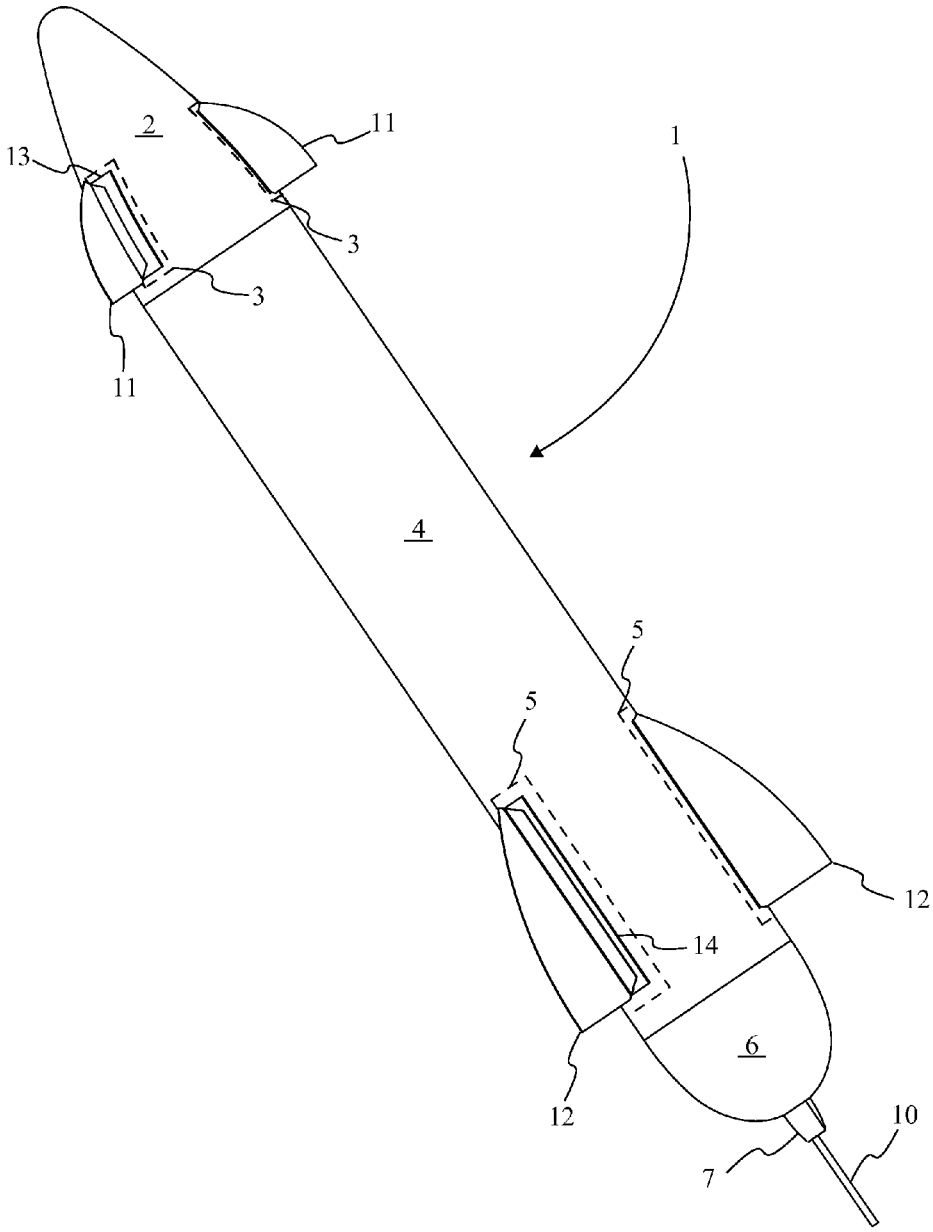
FIG. 5 is a perspective view displaying the detachable engagement of the inflatable body and the fluid delivery conduit as per the current embodiment of the present invention.

Referencing FIG. 4 and FIG. 5, the tail section 6, in the current embodiment of the present invention, is provided as the most rearwardly positioned section of the inflatable rocket assembly. In the current embodiment of the present invention, the tail section 6 comprises a conduit mount 7. The conduit mount is provided as the centrally positioned attachment point for the fluid delivery conduit 10. The conduit mount 7 is found in fluid communication with the fluid chamber 9, wherein the fluid communication is a directionally biased engagement that allows the passage of fluid into the fluid chamber 9. The conduit mount 7 is provided with a detachable engagement to the fluid delivery conduit 10. The detachable engagement permits the fluid delivery conduit 10 to temporarily attach to the conduit mount 7 in order to provide fluid to the fluid chamber 9 while being able to detach when fluid chamber 9 is sufficiently full. In the current embodiment of the present invention the conduit mount 7 comprises a one way valve 8. The one way valve 8 is found positioned between the fluid delivery conduit 10 and the fluid chamber 9. The positioning of the one way valve 8 permits fluid communication between the fluid delivery conduit 10 and the fluid chamber 9. The one way valve 8 provides means of directionally sealing the fluid chamber 9 that forms a bias favoring movement of said fluid towards the fluid chamber 9. When the fluid delivery conduit 10 is coupled to the conduit mount 7, fluid is permitted to move through the fluid delivery conduit 10 across the one way valve 8 and into the fluid chamber 9, while denying fluid movement from the fluid chamber 9.

In the current embodiment of the present invention, the inflatable rocket assembly is provided for construction through human capable means. The plurality of front fins 11, the plurality of tail fins 12, the front fin adhesive coupler, and the tail fin adhesive coupler are provided detached from the inflatable body 1, while the inflatable body 1 is provided in deflated state. The construction of the inflatable rocket assembly comprises the steps of inflating the inflating the inflatable body 1 and attaching the plurality of front fins 11 and the plurality of tail fins 12 to said inflatable body 1 by way of the front fin adhesive coupler and the tail fin adhesive coupler, respectively. The step of inflating the inflatable body 1 further comprises the steps of attaching the fluid delivery conduit 10 to the conduit mount 7 of the tail section 6. The aforementioned step is proceeded by a user directing a fluid through the fluid delivery conduit 10, which traverses across the one way valve 8 and into the fluid chamber 9. It should be noted that in the preferred embodiment of the present invention the fluid utilized to fill the fluid chamber 9 is provided as air. The user would fill the fluid chamber 9 until the pressure of the fluid chamber 9 was sufficient to provide a semi-rigid shape to the inflatable body 1. Upon filling the fluid chamber 9 the use would remove the fluid delivery conduit 10 from the conduit mount 7.

In the current embodiment of the present invention, inflation of the inflatable body 1 would allow the user to begin the attachment of the plurality of front fins 11 and the plurality of tail fins 12 by way of the front fin adhesive coupler and the tail fin adhesive couplers 14. The aforementioned step further comprises the attachment of the front fine adhesive coupler and the tail fin adhesive couplers 14 to the plurality of front fin mounts 3 and the plurality of tail fin mounts 5, respectively. It should be noted that the front fin adhesive coupler and the tail fin adhesive couplers 14 are provided as a piece of double sided tape with both side utilizing a detachable paper strip, which upon detachment of the paper strip exposes the adhesive. With the front fin adhesive coupler and the tail fin adhesive coupler attached to the plurality of front fin mounts 3 and the plurality of tail fin mounts 5, the user would be able to proceed to couple the plurality of front fins 11 and the plurality of tail fins 12 to the front fin adhesive couplers 13 and the tail fin adhesive couplers 14, respectively. It should be noted that in the current embodiment of the present invention the plurality of front fins 11 and the plurality of tail fins 12 are provided as a formed sheet. The formed sheet provides a minimal forward cross-section by way of a tapered lateral cross-section. The formed sheet is provided with a fin section and a lower folded section. The fin section corresponds to the stabilizing portion of the formed sheet while the lower folded section functions as the attachment point with the front fin adhesive couplers 13 and the rear fin adhesive couplers. With the plurality of front fins 11 and the plurality of tail fins 12 attached to the front fin adhesive coupler and the tail fin adhesive coupler, the user would be able to vary the flight path of the inflatable rocket assembly by angling each of the plurality of front fins 11 and each of the plurality of tail fins 12 to the front fin adhesive coupler and the tail fin adhesive coupler, respectively. Through the manipulation of the angle of alignment of each of the plurality of front fins 11 and each of the plurality of tail fins 12 to their respective adhesive couplers, the user would be able to create unique flight patterns.

In the current embodiment of the present invention, the inflatable rocket assembly is provided with the ability to sail through the air with very little effort. The inflatable rocket assembly is inflated with a fluid delivery conduit 10 that is provided as a straw. The straw is provided as being long enough for the user inflates the inflatable rocket assembly but can additionally be provided as means of deflating the inflatable rocket assembly. In current embodiment of the present invention, the straw is provided as with a size and shape that allows facilitated transport by the user in order to allow the user to inflate and deflate the inflatable rocket assembly at their choosing.

In the preferred embodiment of the present invention, the inflatable rocket assembly is provided with the dimensions of 41" inches length and 7.25" inches width. The conduit mount 7 of the tail section 6 is 1.25" inches in length. The preferred embodiment of the present invention utilizes Mylar is the elected material for the inflatable body 1 due to the light weight construction and experimentally determined optimal flight characteristics when thrown by a user.

In the preferred embodiment of the present invention, the front fin adhesive couplers 13 and the tail fin adhesive couplers 14 are provided as double-sided tape. The double sided tape is used to detachably couple the plurality of front fins 11 and the plurality of tail fins 12 to the plurality of front fin mounts 13 and the plurality of tail fin mounts 14, respectively.

In the preferred embodiment of the present invention, the plurality of front fins 11 and the plurality of tail fins 12 are provided as three front fins and three tail fins, respectively. It should be noted that while the present invention utilizes a total of six fins, any number of fins can be configured.

Although the invention has been explained in relation to its preferred embodiment, it is to be understood that many other possible modifications and variations can be made without departing from the spirit and scope of the invention as hereinafter claimed.

What is claimed is:

1. An inflatable rocket assembly comprises: an inflatable body; a fluid delivery conduit; a plurality of front fins; a plurality of tail fins; front fin adhesive couplers; tail fin adhesive couplers; the inflatable body comprises a nose cone section, a cylindrical mid section, a tail section, and a fluid chamber; the nose cone section comprises a plurality of front fin mounts; the cylindrical front section comprises a plurality of tail fin mounts; the tail section comprises a conduit mount; and the conduit mount comprises a one way valve; wherein, the inflatable body is constructed of biaxially-oriented polyethylene terephthalate (BoPET).

2. The inflatable rocket assembly as claimed in claim 1 wherein, the inflatable body further comprises a mirrored exterior surface.

3. The inflatable rocket assembly as claimed in claim 1 comprises:

the inflatable body being concentrically positioned to the plurality of front fins, the plurality of tail fins, the front fin couplers, and the tail fin couplers;

the inflatable body being centrally aligned with the fluid delivery conduit;

the fluid delivery conduit being detachably engaged to the inflatable body;

the front fin adhesive couplers being positioned between the inflatable body and the plurality of front fins;

the tail fin adhesive couplers being positioned between the inflatable body and the plurality of tail fins;

the fluid chamber being enclosed within the inflatable body;

the nose cone section, the cylindrical mid section, and the tail section being centrally aligned along the inflatable body; and the cylindrical mid section being positioned between the nose cone section and the tail section.

4. The inflatable rocket assembly as claimed in claim 1 comprises:

the conduit mount being centrally positioned on the tail section;

the conduit mount being in fluid communication with the fluid chamber;

the plurality of front fin mounts being circumferentially positioned on the nose cone section;

the plurality of tail fin mounts being circumferentially positioned on the cylindrical mid section; and the plurality of tail fin mounts being positioned proximal to the tail section.

5. The inflatable rocket assembly as claimed in claim 4 comprises:

the plurality of front fins being coupled to the plurality of front fin mounts by way of the front fin adhesive couplers; and the plurality of tail fins being coupled to the plurality of tail fin mounts by way of the tail fin adhesive couplers.

6. The inflatable rocket assembly as claimed in claim 4 comprises:

the conduit mount being detachably engaged to the fluid delivery conduit;

the one way valve being positioned between the fluid delivery conduit and the fluid chamber;

the fluid delivery conduit being in fluid communication with the fluid chamber by way of the one way valve; and the fluid chamber being directionally sealed by way of the one way valve, wherein the directionality favors movement of a fluid towards the fluid chamber.

7. An inflatable rocket assembly comprises:

an inflatable body, a fluid delivery conduit;

a plurality of front fins;

a plurality of tail fins;

front fin adhesive couplers;

tail fin adhesive couplers;

the inflatable body comprises a nose cone section, a cylindrical mid section, a tail section, and a fluid chamber;

the nose cone section comprises a plurality of front fin mounts;

the cylindrical front section comprises a plurality of tail fin mounts;

the tail section comprises a conduit mount;

the conduit mount comprises a one way valve; and the inflatable body is constructed of biaxially-oriented polyethylene terephthalate (BoPET).

8. The inflatable rocket assembly as claimed in claim 7 wherein, the inflatable body further comprises a mirrored exterior surface.

9. The inflatable rocket assembly as claimed in claim 7 comprises:

the inflatable body being concentrically positioned to the plurality of front fins, the plurality of tail fins, the front fin couplers, and the tail fin couplers;

the inflatable body being centrally aligned with the fluid delivery conduit;

the fluid delivery conduit being detachably engaged to the inflatable body;

the front fin adhesive couplers being positioned between the inflatable body and the plurality of front fins;

the tail fin adhesive couplers being positioned between the inflatable body and the plurality of tail fins;

the fluid chamber being enclosed within the inflatable body;

the nose cone section, the cylindrical mid section, and the tail section being centrally aligned along the inflatable body;

the cylindrical mid section being positioned between the nose cone section and the tail section;

the conduit mount being centrally positioned on the tail section;

the conduit mount being in fluid communication with the fluid chamber;

the plurality of front fin mounts being circumferentially positioned on the nose cone section;

the plurality of tail fin mounts being circumferentially positioned on the cylindrical mid section; and the plurality of tail fin mounts being positioned proximal to the tail section.

10. The inflatable rocket assembly as claimed in claim 9 comprises:

the plurality of front fins being coupled to the plurality of front fin mounts by way of the front fin adhesive couplers;

the plurality of tail fins being coupled to the plurality of tail fin mounts by way of the tail fin adhesive couplers;

the conduit mount being detachably engaged to the fluid delivery conduit;

the one way valve being positioned between the fluid delivery conduit and the fluid chamber;

the fluid delivery conduit being in fluid communication with the fluid chamber by way of the one way valve; and the fluid chamber being directionally sealed by way of the one way valve, wherein the directionality favors movement of a fluid towards the fluid chamber.

11. An inflatable rocket assembly comprises:

an inflatable body, a fluid delivery conduit;

a plurality of front fins;

a plurality of tail fins;

front fin adhesive couplers;

tail fin adhesive couplers;

the inflatable body comprises a nose cone section, a cylindrical mid section, a tail section, and a fluid chamber;

the nose cone section comprises a plurality of front fin mounts;

the cylindrical front section comprises a plurality of tail fin mounts;

the tail section comprises a conduit mount;

the conduit mount comprises a one way valve;

the inflatable body is constructed of biaxially-oriented polyethylene terephthalate (BoPET);

the inflatable body being concentrically positioned to the plurality of front fins, the plurality of tail fins, the front fin couplers, and the tail fin couplers;

the inflatable body being centrally aligned with the fluid delivery conduit;

the fluid delivery conduit being detachably engaged to the inflatable body;

the front fin adhesive couplers being positioned between the inflatable body and the plurality of front fins;

the tail fin adhesive couplers being positioned between the inflatable body and the plurality of tail fins;

the fluid chamber being enclosed within the inflatable body;

the nose cone section, the cylindrical mid section, and the tail section being centrally aligned along the inflatable body;

the cylindrical mid section being positioned between the nose cone section and the tail section;

the conduit mount being centrally positioned on the tail section;

the conduit mount being in fluid communication with the fluid chamber;

the plurality of front fin mounts being circumferentially positioned on the nose cone section;

the plurality of tail fin mounts being circumferentially positioned on the cylindrical mid section;

the plurality of tail fin mounts being positioned proximal to the tail section;

the plurality of front fins being coupled to the plurality of front fin mounts by way of the front fin adhesive couplers;

the plurality of tail fins being coupled to the plurality of tail fin mounts by way of the tail fin adhesive couplers;

the conduit mount being detachably engaged to the fluid delivery conduit;

the one way valve being positioned between the fluid delivery conduit and the fluid chamber;

the fluid delivery conduit being in fluid communication with the fluid chamber by way of the one way valve; and the fluid chamber being directionally sealed by way of the one way valve, wherein the directionality favors movement of a fluid towards the fluid chamber.

12. The inflatable rocket assembly as claimed in claim 11 wherein, the inflatable body further comprises a mirrored exterior surface.

* * * * *